United States Patent [19]

Hirono et al.

[11] 4,210,499

[45] Jul. 1, 1980

[54] METHOD OF FORMING COLORED PATTERNS ON ALUMINUM OR ITS ALLOYS

[75] Inventors: Hatsuo Hirono, Nyuzen; Katsuyuki Nagata, Uozu; Nobushige Doguchi, Toyama, all of Japan

[73] Assignee: Yoshida Kogyo K.K., Tokyo, Japan

[21] Appl. No.: 964,464

[22] Filed: Nov. 29, 1978

[30] Foreign Application Priority Data

Dec. 5, 1977 [JP] Japan ..... 52-145192

[51] Int. Cl.[2] ..... C25D 11/20

[52] U.S. Cl. ..... 204/38 A; 204/38 E; 204/42; 427/280; 427/434.2; 148/6.1

[58] Field of Search ..... 118/402; 427/434 A, 427/280, 281; 204/18 R, 35 N, 38 A, 38 E, 42; 428/106; 148/6.1

[56] References Cited

U.S. PATENT DOCUMENTS

| | | | |
|---|---|---|---|
| 137,127 | 3/1873 | Carson | 427/268 |
| 3,218,243 | 11/1965 | Michelson | 148/6.1 |
| 3,284,321 | 11/1966 | Fromson | 204/42 |
| 3,450,606 | 6/1969 | Darrow | 204/18 R |
| 4,091,126 | 5/1978 | Hidan | 148/6.1 |

FOREIGN PATENT DOCUMENTS

| | | | |
|---|---|---|---|
| 19395 | of 1892 | United Kingdom | 427/259 |

*Primary Examiner*—Ralph S. Kendall

*Attorney, Agent, or Firm*—Hill, Van Santen, Steadman, Chiara & Simpson

[57] ABSTRACT

A colored pattern imitating the grain of wood is formed on the surface of an article formed of an aluminum or its alloys by dipping the article, after oxidation process, in a coating bath floating a coating material in a multilinear or multiannular pattern to deposit the coating material in a wood grain pattern on the surfaces of the article and applying thereto a finish coating.

6 Claims, No Drawings

METHOD OF FORMING COLORED PATTERNS ON ALUMINUM OR ITS ALLOYS

BACKGROUND OF THE INVENTION (1) Field of the Invention

This invention relates to methods of forming colored patterns on the surfaces of aluminum or its alloys without using such dyes and pigments as hitherto being used for coloring of aluminum or its alloys.

(2) Description of the Prior Art

Hitherto, various methods have been known in the art for forming colored patterns on the surfaces of aluminum or its alloys. In prior methods, as disclosed in Japanese Patent Publication Nos. 4616/75 and 3895/77 and Japanese Patent Application laid open to public inspection No. 41735/77, a resist film is applied to or printed on an aluminum work piece to form protected areas in confirmity with a desired pattern, the work piece is then subjected to an anodic oxidation to form thereon a barrier-type oxide film or to a chemical conversion to form a chemically oxidized film and, after removal of the resist film, to the second anodic oxidation or chemical conversion to form a pattern of a colored film, namely, the prior methods include the steps of: resist pattern printing, primary anodic oxidation, (stopping-up of pores), removal of resist films, secondary anodic oxidation (electrolytic coloring); or, resist pattern printing, chemical oxide film formation, removal of resist film and chemical conversion (chemical formation of colored oxide film). Another method which also includes a printing step for patterning is disclosed in Japanese Patent Publication No. 21022/76 which comprises applying a TFS coating to the surface of an aluminum work piece, applying a pattern coating thereon by means of screen printing or off-set printing and dryng and baking together the TFS coating and pattern coating. These prior methods including essentially a printing process for patterning have a shortcoming that the printing process is expensive and takes much time and, consequently, results in decrease in the mass productivity or productivity of the methods and, in addition, the printing process makes it difficult to produce a great variety of patterns each at relatively small produce.

A method of forming patterns on aluminum or its alloys without employing any printing process is disclosed in Japanese Patent Application laid open to public inspection No. 60244/77 which comprises subjecting an aluminum work piece to electrolysis in an alkaline electrolytic bath added with a barrier-type oxide film forming electrolyte by means of an alternating current or current exhibiting the same effect with alternating current. Japanese Patent Application laid open to public inspection Nos. 3535/77, 61139/77 and 70951/77 disclose methods of forming colored patterns on aluminum surfaces by electrolytic coloring through control of electrolytic formation of a barrier-layer after anodic oxidation. However, these methods in which colored patterns are formed by electrolytic coloring after modification of the thickness of the barrier-layer are unsuitable for work pieces having complicated shapes and poor in productivity because of difficulty in modification of the thickness of the barrier-layer. On the other hand, the method as disclosed in Japanese Patent Application laid open to public inspection No. 60244/77 is applicable to work pieces having complicated shapes, though the patterns formed in this method are lengthwise extending short etching figures which are somewhat similar to but far apart from the straight grain of natural wood and it is impossible to form pattern imitating the cross grain of wood.

SUMMARY OF THE INVENTION

Accordingly, it is a principle object of the present invention to provide a method of forming a colored pattern with a close resemblance to a straight or cross grain of natural wood on the surface of aluminum or its alloys.

Another object of the present invention is to provide a method of forming multi-colored or multi-toned patterns with a close resemblance to a straight or cross grain of natural wood on the surface of aluminum or its alloys.

Still another object of the present invention is to provide an aluminum article having the colored patterns on its surface and improved weathering and chemical resisting properties.

In a method of the present invention, a colored pattern is formed on the surface of an aluminum work piece by, after formation of a chemically oxidized film, anodic oxide film or colored anodic oxide film in a usual manner, dipping the work piece in a coating bath including a coating material in a multilinear or multiannular pattern floated therein, and thereafter a finish coating is applied to the work piece. A electrolytic coloring may be used in place of the oxide film formation.

DETAILED DESCRIPTION OF THE INVENTION

An article formed of an aluminum or its alloys, hereinafter referred to as "work piece," is subjected to a formation of an oxide film such, e.g., a chemically oxidized film, an anodic oxide film and a colored oxide film by the known methods after degreasing, washing, drying or like ordinary treatments and, optionally, etching, desmutting or like special treatments. The chemically oxidized film is formed by dipping the work piece into a solution containing chromate, phosphate, acetate, sulfate, nitrate, fluoride, etc.. The anodic oxide film is formed by electrolytically oxidizing the work piece in an acid electrolyte, such as sulfuric acid, oxalic acid, chromic acid, etc., and the colored anodic oxide film is formed by using an electrolyte containing at least one of the organic acid selected from oxalic acid, malonic acid, citric acid, maleic acid, tartaric acid, sulfo-salicylic acid, sulfo-phthalic acid, etc., or by using a mixture electrolyte of inorganic acid with said organic acid. The aluminum work piece thus formed thereon an oxide film is then dipped in a coating bath floating a coating material in a multilinear or multiannular pattern to deposit thereon a coating in a wood grain pattern. In case where the coating material floats in the multilinear pattern there is formed a pattern of a straight grain of wood, while in case of the multiannular patternn or pattern of water rings there is formed a cross grain pattern. The work piece is then, after drying or directly, subjected to a finish coating in a spray or dip coating process and to drying and baking. For mass production, it is preferred to carry out and finish coating after the pattern coating in a dip coating process like the pattern coating.

In accordance with another embodiment of the present invention, an aluminum work piece is, after the pretreatment as mentioned above or anodic oxidation, subjected to an electrolytic coloring in an inorganic metallic salt-containing electrolytic bath or to a formation of a colored oxide film by the aid of an organic acid. The electrolytic coloring is carried out by anodic oxidation using an acid electrolyte containing a metallic salt, such as nitrate, sulfate, phosphate, oxalate, acetate, tartrate, etc. of nickel, chrome, cobalt, copper, magnesium, iron, manganese, molybdenum, lead, zinc, etc. This process, also known as the ANOLOK process, is carried out after conventional anodic oxidation by applying an A.C. or a D.C. voltage between the anodized workpiece and a suitable counter-electrode located in a coloring electrolyte containing metallic salts of inorganic acids. As a result, metal oxides or hydroxides are electrolytically deposited in the pores of the anodic oxide film, the deposited material itself providing the color. This process is disclosed in U.S. Pat. No. 3,382,160. The latter is carried out by anodic oxidation in an ordinary electrolytic bath containing at least one of the organic acid selected from oxalic acid, malonic acid, citric acid, maleic acid, tartaric acid, sulfo-salicylic acid, sulfo-phthalic acid, etc., or a mixture solution of inorganic acid with said organic acid. This organic-acid colored film, also known as "electrolytic coloring formation" or "internal color anodizing", results in the anodic oxide film, which is deposited on the surface of the work piece, providing its own color. This process is described in U.S. Pat. Nos. 3,31,387; 3,143,485, and 3,146,178. The work piece is then applied, in the same manner as mentioned above, with a mask coating in a wood grain pattern and the work piece thus locally masked is subjected again to an electrolytic coloring or electrolytic color formation. A finish coating is applied to the work piece directly or after removal of the patterned mask coating. In the latter case, the following finish coating may suitably be performed in an electrodeposing process as well as in a spray or dip coating process.

The aforesaid patterned mask coating is carried out in the procedure as follows. A coating material is poured on to the surface of a coating bath filled up with slowly flowing water from the up-stream end of the bath as to form a number of streaks floating on the surface of water. Flow of the bath and supply of the coating material are stopped just before the front ends of the extending streaks arrive at the overflow end of the bath, and the work piece hung down lengthwise is dipped in the bath to deposit on its surfaces the floating coating material in a wood grain pattern. In this process, it is preferred that the work piece has previously been well dried and is hung down lengthwise and that the width of the coating bath is ½ to ⅔ times the length of the work piece. When the width of the coating bath is not enough, the coating material should be continuously poured in the coating bath at a rate so controlled as to form the continuous thin streaks like wood pattern on the surface of the work piece with respect to the dipping speed of the work piece. The floating streaks of the coating material in the coating bath may be formed also by supplying the coating material to the end opposite to the overflow end of the coating bath to accumulate therein the coating material and spreading it towards the overflow end by means of a blade having notches at intervals in its bottom edge. When the mask coating is carried out in this manner, there is formed a mask coating in a pattern of a straight wood grain.

In order to form a pattern of cross grain of wood, the coating material is dropped to the surface of a coating bath to form thereon a multiannular pattern or pattern of water rings and the dropping of the coating material is continued at a rate suitable to the dipping speed of the work piece.

Water is usually used for floating the coating material, though the workability of the coating bath is improved by adding thereto a surface-active agent.

The residual coating material may deposit on the wet surface of the work piece as the work piece is drawn up, but the deposits of the residual coating material are easily removed by means of, e.g., air agitation in a washing bath because the coating material can not firmly stick to the wet surface of the work piece. Addition of a small amount of a surface active agent to the washing bath is effective. In case where it is desired to omit the washing process, drawing-up of the work piece should be done after removal of the residual coating material by overflowing.

As the patterning coating materials suitably used are: acrylic resin coatings such as, e.g., modified acrylic lacquer (acrylic resin/nitrocellulose), alkyd coatings such as, e.g., high solid lacquer (benzoic acid-modified alkyl resin nitrocellulose) and the like, and the coatings may be pigmented into various desired colors. Since it is necessary for obtaining a finely finished pattern to prevent break-up of the streaks of the coating material, it is occasionally desired to reinforce the coating material by incorporating therein a small amount of microfilm.

As to finish coating materials there may suitably be used coating materials based on acrylic resin, amino resin, polyurethane resin, silicone resin, alkyd resin and like thermosetting synthetic resins.

As illustrated above, in accordance with the present invention a fine wood grain pattern can be applied to the whole surface of work piece by processing it in lengthwise hung-down state even if it is of a complicated shape, because the application of the pattern coating is carried out in a dip coating process. The method of the present invention may be carried out in an alumite line in which work pieces are processed in lengthwise hung-down state, and, in addition, there are obtainable a great number of colored patterns in combination of various ground colors such as, e.g., silver, amber, bronze and gold by appropriate choice of pigments to be incorporated into the pattern coatings.

It is one of the characteristic features of the present invention that, since the pattern coating is deposited on the work piece from a floating layer of a coating material over liquid surface, there are obtained colored patterns which resemble closely to but not identical with each other. After application of the colored pattern, a clear finish coating may be applied thereover to obtain a coating film of improved weathering and chemical resisting properties which make it possible to employ the coated product as a durable exterior material of buildings without any trouble.

The present invention will be illustrated in more detail by the following examples.

EXAMPLE 1

An aluminum extruded sheet, A-6063S, of a length of 20 cm and a width of 7 cm which had previously been degreased, etched and desmutted in the usual ways was subjected to an anodic oxidation in a 17.5 w/v % sulfuric acid electrolyte, washed with water and dried. A black modified acrylic lacquer enamel (acrylic resin/nitrocellulose) diluted with a thinner to an IHS cup consistency of 11 seconds was poured at five points on to the surface of water slowly flowing in one direction to form in the surface five thin streaks of the enamel extending in the direction of the flow of water. The flow of water and supply of enamel were stopped just before the arrival of the front ends of the lines of coating at the overflow end of the bath, and the aluminum sheet was slowly dipped in the bath to deposit thereon a patterned coating. The sheet was then drawn up, dried in air, dip coated with an acrylic clear lacquer and baked at 180° C. for 30 minutes to obtain a black pattern of wood grain on a silvery ground of the anodic oxide film.

EXAMPLE 2

After anodic oxidation and washing with water in the same manners as in Example 1, the aluminum sheet was electrolytically colored to bronze by A.C. electrolysis under a voltage of 15 V for 2 minutes using a carbon counter electrode in an electrolytic bath of the following composition.

Electrolytic bath:

Nickel sulfate (hexahydrate): 30 g/l
Magnesium sulfate (heptahydrate): 15 g/l
Boric acid: 20 g/l
Ammonium sulfate: 30 g/l
Sodium dithionite: 0.5 g/l
pH: 5.6
Bath Temperature: 20° C.

The sheet was then washed with water, dried and subjected to the pattern coating and clear lacquer coating in the same manners as in Example 1 to obtain a black wood grain pattern on a bronze ground of the electrolytic color film.

EXAMPLE 3

After the anodic oxidation and washing in the same manners as in Example 1, the aluminum sheet was electrolytically colored to gold by A.C. electrolysis at 15 volts for 6 minutes using a carbon counter electrode in an electrolytic bath of the following composition.

Electrolytic bath:

Sodium selenite: 2 g/l
Sulfuric acid: 10 g/l
Bath temperature: 20° C.

The sheet was washed with water, dried and subjected to the same patterning and finish coating as in Example 1 to obtain a black wood grain pattern on a golden ground of the colored oxide film.

EXAMPLE 4

After the anodic oxidation and washing in the same manners as in Example 1, the aluminum sheet was electrolytically colored to bronze by an A.C. electrolysis at 15 volts for 2 minutes, using a carbon counter electrode in an electrolytic bath f the following composition.

Electrolytic bath:

Nickel sulfate (hexahydrate): 30 g/l
Magnesium sulfate (heptahydrate): 15 g/l
Boric acid: 20 g/l
Ammonium sulfate: 30 g/l
Cobalt sulfate (heptahydrate): 25 g/l
pH: 5.6
Bath temperature: 20° C.

A modified acrylic (acrylic resin/nitrocellulose) clear lacquer diluted to an IHS cup consistency of 11 seconds was poured at five points on to the surface of water slowly flowing in one direction as to form, in the surface of water, five thin lines of the lacquer extending in the direction of the flow of water. The flow of water and supply of the lacquer were stopped just before the arrival of the front ends of the lines of the lacquer at the overflow end of the bath, and the colored aluminum sheet was, after washing with water and drying, dipped slowly in the coating bath to deposit the lacquer in a wood grain pattern on the surface of the sheet. The sheet was drawn up, dried in air, subjected again to the A.C. electrolytic coating at 18 volts for 3 minutes, washed with water, dip coated with an acrylic clear lacquer and baked at 180° C. for 30 minutes. Thus, there was obtained a bronzed pattern of wood grain, being lighter in pattern coated areas and darker in uncoated areas.

EXAMPLE 5

The same procedure as in Example 1 was repeated except that the aluminum sheet was, in place of the anodic oxidation in the sulfuric acid electrolytic bath, subjected to a D.C. electrolysis at a current density of 2 $A/dm^2$ for 30 minutes in a mixed electrolytic bath containing sulfosalicylic acid in a strength of 100 g/l and sulfuric acid in a strength of 5 g/l to electrolytically color the sheet to a light amber. Thus, there was formed a black wood grain pattern on a light amber ground of the electrolytically colored coating.

EXAMPLE 6

The same procedure as in Example 1 was repeated except that, in place of pouring of the patterning coating material in the coating bath, a black high solid lacquer enamel (benzoic acid-modified alkyd resin/nitrocellulose) was dropped on the surface of a water bath until there was formed a multiannular or water ring pattern of the outermost diameter of 30 cm and an aluminum sheet was slowly dipped in the center of the pattern to deposit the enamel in a pattern of a cross grain of wood. Thus, there was obtained a fine-grained black pattern of a cross grain of wood.

EXAMPLE 7

An aluminum sheet as used in Example 1 was subjected to an anodic oxidation and washing with water in the same manners as in Example 1 and then to an A.C. electrolysis at 15 volts for 2 minutes in an electrolytic bath of the following composition using a carbon counter electrode to electrolytically color it.

Electrolytic bath:

Stannous sulfate: 5 g/l
Sulfuric acid: 10 g/l
Nickel sulfate (hexahydrate): 30 g/l
Bath temperature: 20° C.

The sheet was then washed with water and dried. A black modified acrylic (acrylic resin/nitrocellulose) lacquer enamel diluted to an IHS cup consistency of 11 seconds was poured at five points on to the surface of water slowly flowing in one direction as to form, in the surface of flowing water, five thin flows of the enamel and flow of water and pouring of the enamel were stopped just before the arrival of the front ends of the lines of coating at the overflow end of the bath, and the aforesaid aluminum sheet was slowly dipped in the bath to deposit a wood grain pattern thereon. The sheet was drawn up, dried in air, subjected again to a D.C. electrolytic coloring at 18 volts for 3 minutes, washed with water, soaked in a 98% sulfuric acid for 2 minutes for removal of the wood grain patterned coating, washed with water and washed in pure hot water at 80° C. for 10 minutes. The sheet was then soaked as an anode in an 8% aqueous solution of a thermosetting acrylic electrodepositing coating composition and subjected to an electrodeposition by applying direct voltage of 150 volts for 2 minutes between the anode and a stainless steel (SUS 304) counter electrode. The so electrodeposited sheet was then baked at 180° C. for 30 minutes to obtain a finished sheet having a wood grain pattern wherein wood grain coated areas are light amber and uncoated areas are dark amber.

What we claim is:

1. A method of forming a colored pattern of wood grain on the surface of an article made of aluminum of its alloys comprising:

anodically oxidizing the surface of said article to form an oxide film on said surface;

forming a colored film on the anodized surface of said article by means of electrolytic coloring in an electrolytic bath;

dipping said article into a coating bath having a resinous coating material, selected from the group consisting of acrylic resins or alkyd resins, in the form of multilinear or multiannular patterns floated thereon to deposited a clear coated, colored woodgrain pattern on said article;

forming a colored film on the pattered anodized surface of said article by means of electrolytic coloring; and applying a finishing coating to said article.

2. A method as claimed in claim 1, wherein a pigment is incorporated into the resinous coating material for patterning.

3. A method as claimed in claim 1, wherein the coating material for patterning is floated on water.

4. A method as claimed in claim 3, wherein a surface-active agent is incorporated into the water.

5. A method of forming a colored pattern on the surface of an article made of an alluminum or its alloys as described in claim 1, wherein said colored film is formed by means of electrolytic coloring in an electrolytic bath containing a metallic salt of an inorganic acid.

6. A method of forming a colored pattern on the surface of an article made of an aluminum or its alloys as described in claim 1, wherein said colored film is formed by means of an anodization in an electrolytic bath containing an organic acid.

* * * * *